United States Patent [19]

McEwan

[11] Patent Number: 4,752,719

[45] Date of Patent: Jun. 21, 1988

[54] BOOSTED D.C. SUPPLY CIRCUIT AND LUMINAIRE EMPLOYING SAME

[76] Inventor: Robert A. McEwan, 269 Manhattan St., Staten Island, N.Y. 10307

[21] Appl. No.: 93,088

[22] Filed: Sep. 1, 1987

Related U.S. Application Data

[63] Continuation of Ser. No. 721,789, Apr. 10, 1985.

[51] Int. Cl.[4] ..... H05B 37/00

[52] U.S. Cl. ..... 315/200 R; 313/579; 315/91

[58] Field of Search ..... 315/200 R, 246, 316, 315/318, 321; 313/579

[56] References Cited

U.S. PATENT DOCUMENTS

| | | | |
|---|---|---|---|
| 3,459,995 | 9/1969 | Rea | 315/200 R |
| 4,001,637 | 1/1977 | Gray | 315/200 R |
| 4,078,188 | 3/1978 | Martin et al. | 315/579 |
| 4,149,086 | 4/1979 | Nath | 250/504 |

OTHER PUBLICATIONS

Advertisement for "Mellin Lite-Savers", in the Selective Shopper, (undated).

American Cinematographer, Jun. 1963, p. 205.

"Price List-Commercial and Industrial Motion Picture and Television Lighting Equipment (Boosted)", by ColorTran Industries.

Lighting Handbood, 7th Edition, by Sylvannia Lighting Center, GTE Products Corp., 1984.

"Sylvannia Incandescent Lamp Rule", GTE Products Corp., Sylvannia Lighting Center.

Brochures by J. G. McAlister Inc., featuring "The Work Horse" converter, and The Executive Converter.

*Primary Examiner*—David K. Moore

*Assistant Examiner*—T. Salindong

*Attorney, Agent, or Firm*—Davis Hoxie Faithfull & Hapgood

[57] ABSTRACT

A luminaire using a tungsten-halogen lamp, includes a circuit for supplying the lamp with a boosted D.C. operating voltage. The circuit includes a full-wave rectifying circuit for receiving a standard A.C. mains supply voltage, and a low pass filter connected to the output of the rectifier. The value of the time constant of the filter is chosen to produce at the rectifier output, an average D.C. voltage of about between 135 and 146 volts, preferably about 140 volts.

7 Claims, 2 Drawing Sheets

BOOSTED D.C. SUPPLY CIRCUIT AND LUMINAIRE EMPLOYING SAME

This is a continuation of co-pending application Ser. No. 721,789, filed on Apr. 10, 1985.

FIELD OF THE INVENTION

The present invention is directed to the field of incandescent lighting, and in particular to the field of high intensity lighting systems designed for use in television, motion pictures, theater and professional photography.

BACKGROUND OF THE INVENTION

In general, proper lighting for television, motion pictures, theater, and professional photography is difficult to achieve. Lighting systems designed for such use, on one hand must provide very large amounts of light, and on the other hand are limited by the amount of space available, the amount of heat and noise (60 cycle hum) generated by the lights, the amount of available power and overall cost of the system. It is therefore highly desirable to increase the efficiency of any lighting system, commonly measured in terms of lumens per watt, thereby reducing the amount of space, equipment, heat and noise produced by, and power required by a given lighting system.

One of the major factors affecting the operation of a lighting system is the type of lamp employed in any individual lighting unit or "luminaire". One popular lamp developed in the early 1960's is an incandescent lamp in which a gaseous element of the halogen family is provided within the lamp bulb, so as to permit the operation of what is known as the "halogen cycle", which causes particles of the filament which have evaporated therefrom, to be redeposited onto the filament. Such lamps substantially maintain their initial light output over time, without the bulb blackening like a regular incandescent bulb would at high intensities and temperatures. Also, halogen lamps have twice the life of comparable wattage incandescent lamps with the same lumen output, and further, for a given power rating, halogen lamps are more compact than plain incandescent lamps.

The halogen lamps typically employ a quartz bulb, because of the high temperatures that the lamps produce, and have tungsten filaments. Early halogen lamps used iodine as the halogen and were thus referred to as "quartz iodine" lamps, whereas modern-day halogen lamps usually use bromine as the halogen, and are referred to simply as "tungsten-halogen" lamps.

Typical operating characteristics of incandescent lamps, including tungsten-halogen lamps, will be described with reference to FIGS. 1 and 2, which have been duplicated from pages 50 and 51, respectively, of the *Lighting Handbook,* Seventh Edition, by Sylvania Lighting Center, GTE Products Corp., 1984. FIG. 1 illustrates the variation of light output in lumens, and power consumed, in watts, as a function of the A.C. supply voltage applied to an average incandescent lamp. For example, by operating the lamp at 100% of the rated voltage (e.g., operating a 120 volt A.C. (rms) rated lamp at 120 volts A.C. (rms), the lamp will produce 100% of its rated light output, and will consume 100% of its rated power consumption. FIG. 2 illustrates the variation of the life of an average incandescent lamp as a function of the A.C. supply voltage. For example, operating the lamp at 100% of its rated A.C. voltage will provide an average lamp life equal to the rated life, designated in the figure as 100% of the rated life.

It will be appreciated from FIG. 1 that an increase in the A.C. supply voltage will produce a rapid rise in the lumens produced by the lamp, with a considerably slower rise in the watts consumed by the lamp, thus increasing the light output and efficiency of the lamp. However, it will be appreciated from FIG. 2, that an increase in the A.C. supply voltage produces a rapid drop in the rated life of the lamp. For example, at 10% over the rated A.C. voltage, the life of the average lamp will be reduced to less than 30% of its rated life, while an increase of 20% over the rated A.C. voltage reduces the expected life to an unacceptable value. In fact, the Lighting Handbook, referred to above, states, at page 50 that "Tungsten halogen lamps should never be operated at greater than 10% over voltage."

On the other hand, a decrease in the applied voltage will produce a rapid rise in the rated life of the lamp, as shown in FIG. 2, and such characteristics have led to home use of devices for increasing the life of light bulbs through a reduction in the supply voltage applied to the light bulb, by means of a simple half-wave rectifier which may be easily placed into a light socket. Since the A.C. supply voltage is only applied to the light bulb through one-half of its whole cycle, the rms voltage applied to the light bulb is significantly reduced, resulting in a considerably longer bulb life, lower power consumption, but with a lower light output and a lower lamp efficiency.

Lighting for television, theater and professional photography, however, requires very high levels of light. Simply adding more lamps is not an adequate solution in the industry. Lamps are expensive to rent. Lamps are bulky, and space and outlets on lighting trees are limited. Also, two one-thousand watt lamps do not focus as much light on a subject as one two-thousand watt lamp; the amount of lumens produced may be the same in either case, but the amount of light focused on the subject is not. For shooting at remote locations adding extra lamps is particularly difficult, because of transportation, set up and power generating problems. It is thus desirable to increase the light intensity of individual lamps wherever possible. Converters, such as "Garnelite" converters, made in the early to middle 1960s by J. G. McAlister, Inc., Hollywood, Calif., provided an A.C. to A.C. boost of the voltage applied to tungsten halogen lamps to thereby increase the light output of the lamps. However, the amount of increase in light output provided by the tungsten-halogen lamp using such converters, was severely limited, since a boost of about 10% over rated voltage would dramatically reduce lamp life (FIG. 2), with only a relatively small increase in light output (FIG. 1). Thus, operation at over-voltages resulted in increased expense and down time due to shortened lamp life. Such converters are no longer produced.

In the late 1960s, a new type of lamp known as "HMI" (referring to halogen, mercury and iodine) was developed and first introduced in Europe. The HMI lamp is not an incandescent lamp, but rather is a gas discharge device which inherently operates at higher lumens per watt efficiencies than tungsten-halogen lamps. On the other hand, HMI lamps have serious drawbacks. Each lamp requires a ballast, which can weigh over 250 lbs. (for a 12 kilowatt spotlight, for example). HMI lamps are bulky, expensive, require a great deal of room, require long warm-up and restart periods, are very difficult to dim, and cause flicker problems, which are of particular difficulty in movie photography, due to the pulsed nature of the light. The fact that HMI lamps, given their serious deficiencies, have gained favor in the industry and have been widely used attests to the need for sustainable intensities and efficiencies not attainable with tungsten-halogen lamps, even with boosters of the "Garnelite" type.

Further, both tungsten-halogen and HMI lamps produce sometimes unacceptable levels of noise, referred to as "60-cycle hum". On a shooting set lights have to be raised so that the hum does not interfere with microphones on booms. This, of course, exacerbates the lighting problem, because raising the lights lowers the intensity of light on the subject.

OBJECTS OF THE INVENTION

It is therefore an object of the present invention to overcome the difficulties associated with the prior art.

It is a further object of the invention to allow for more efficient operation of incandescent lamps, without a severe reduction in the rated life of the lamp.

It is a further object of the invention to provide a circuit for supplying an operating voltage to tungsten-halogen lamps to thereby increase the efficiency of the lamp, without unduly reducing the rated life of the lamp.

It is a further object of the invention to provide a circuit for supplying an operating voltage to a tungsten-halogen lamp, to allow the lamp to provide a light output approximately double that of the rated light output, while only reducing the rated life of the lamp by approximately 50%.

It is a further object of the invention to provide a lighting system which is less expensive, less expansive, requires less power, produces less heat, and eliminates hum.

It is a further object to provide an improved luminaire.

It is a further object to provide a method for dramatically improving the efficiency and light output of a tungsten-halogen lamp, with an acceptable reduction in lamp life.

SUMMARY OF THE INVENTION

It has been surprisingly discovered that when a D.C. over-voltage is applied to a tungsten-halogen lamp, its rated life is considerably greater than that denoted by the graph of FIG. 2, while the lumen output increases even more rapidly than that denoted by the graph of FIG. 1.

Thus, in accordance with a first aspect of the invention, a circuit for supplying a boosted D.C. operating voltage to a tungsten-halogen lamp includes a full-wave rectifying circuit and a low-pass filter. The full-wave rectifying circuit receives a standard A.C. mains supply voltage and produces a rectified voltage at an output thereof. The low-pass filter has a capacitor and an effective resistance connected in parallel across the output of the rectifier, to filter the rectified voltage. The value of the time constant of the filter is chosen so as to produce at the output of the rectifier an average D.C. voltage of between approximately 135 and 146 volts. This average D.C. voltage is applied to the lamp.

Preferably, the value of the time constant is chosen so as to produce an average D.C. voltage on the order of approximately 140 volts. Where a supply voltage of approximately 120 volts A.C. (rms) and approximately 60 cycles per second is used, the capacitor is approximately 1,200 microfarads.

In accordance with a second aspect of the invention, an improved luminaire comprises a tungsten-halogen lamp in combination with the boosted D.C. supply circuit as described above. The supply circuit may include a dummy load coupled to the input of the full-wave rectifying circuit, and a dimmer electrically connected to said input for reducing the level of the average D.C. voltage as desired.

In accordance with a third aspect of the present invention, a method for increasing the light output and efficiency of a tungsten-halogen lamp includes the steps of rectifying a standard A.C. mains supply voltage to produce a rectified voltage, filtering the rectified voltage so as to provide an average D.C. voltage in the order of approximately 140 volts and applying the average D.C. voltage to the tungsten-halogen lamp.

These and other objects, aspects and embodiments of the present invention will be described in more detail with reference to the following drawing figures.

DETAILED DESCRIPTION OF THE INVENTION

Figure 1:
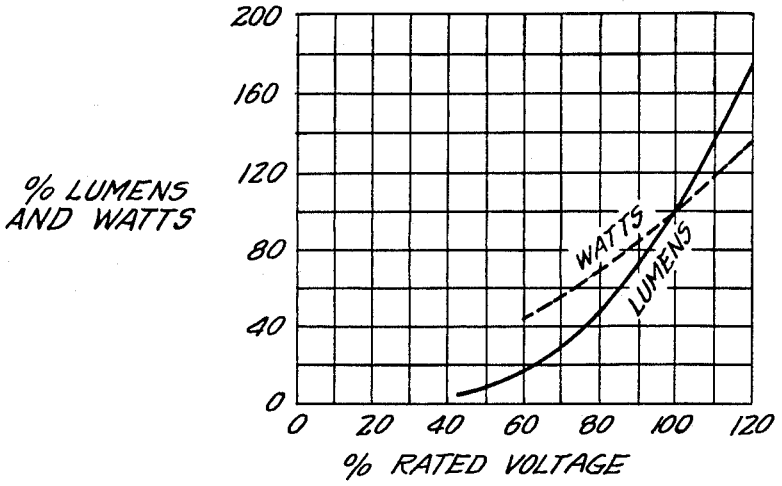
(PRIOR ART) FIG. 1
FIG. 1 is a graph illustrating percent average light output in lumens and power consumption in watts, as a function of percent of rated A.C. voltage (rms) for all incandescent lamps, as discussed above.
Figure 2:
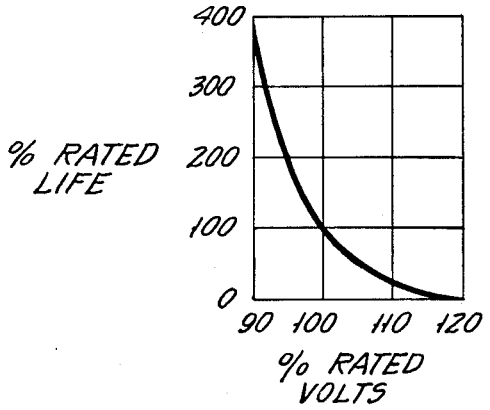
(PRIOR ART) FIG. 2
FIG. 2 is a graph illustrating the variation of percent average rated lamp life with the percent A.C. voltage (rms) applied to the lamp, for all incandescent lamps, as discussed above.
Figure 3:
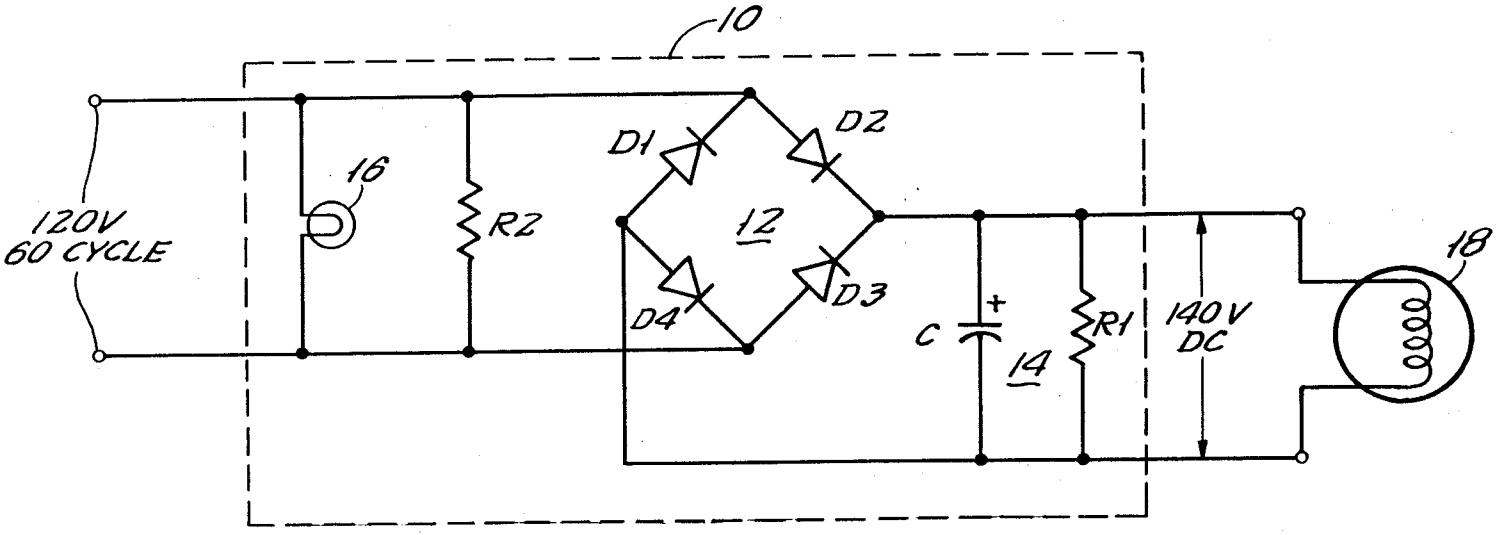
FIG. 3 is a circuit diagram of the boosted D.C. supply circuit in accordance with the present invention.

With refernece to FIG. 3, the boosted D.C. supply circuit 10 in accordance with the present invention includes full-wave rectifier 12, comprising diodes D1–D4 and a low-pass filter 14 comprising capacitor C, and a resistance in parallel with capacitor C, comprising the parallel combination of resistor R1 and the resistance of the tungsten-halogen lamp 18. Resistor R1 also serves the purpose of bleeding off any stray charge held on the capacitor C should the lamp 18 be disconnected. The full-wave rectifier receives a standard 120 volt (rms) 60 cycle A.C. mains supply voltage at the junction of the cathode of diode D1 and the anode of diode D2, and at the junction of the cathode of diode D4 and the anode of diode D3. Shunting the mains supply voltage is a resistor R2 in parallel with an optional pilot light 16, provided to indicate that circuit 10 is connected to the supply voltage, should the lamp 18 be disconnected. Resistor R2 is provided as a dummy load for the dimmer board 20, shown in FIG. 4.

The full-wave rectifier 12 provides a positive output at the junction of the cathodes of diodes D2 and D3, and a negative output at the junction of the anodes of diodes D1 and D4. The positive and negative outputs of the full-wave rectifier are applied across the tungsten-halogen lamp 18 as shown. The capacitor C and resistor R1 of the low pass filter 14 are applied across the output of the full-wave rectifier 12. The capacitor C is preferably of the electrolytic type, the positive terminal of the capacitor being connected to the positive output of the rectifier. The RC time constant of the filter 14 is such that the average D.C. voltage applied to the lamp 18 is within a predetermined range, as described below.

Figure 4:
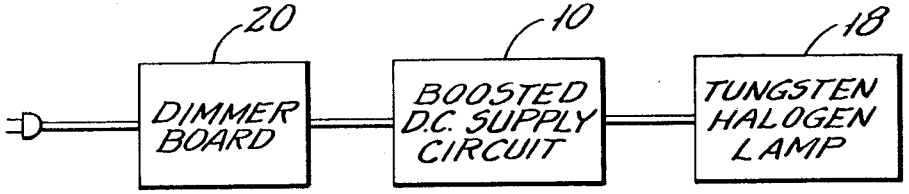
FIG. 4 is a diagram illustrating the use of the boosted D.C. supply circuit, in accordance with the present invention, in combination with a dimmer.

With reference to FIG. 4, it will be seen that the boosted D.C. supply circuit 10 in accordance with the present invention preferably receives the mains supply voltage via a conventional dimmer board 20, and supplies a boosted D.C. output to the tunsten-halogen lamp 18.

It has been found, contrary to conventional wisdom, that a tungsten-halogen lamp can be driven as much as 20% over voltage, if the applied voltage is D.C. rather than A.C., with a dramatic increase in light input, a relatively conservative increase in power consumption, and a very acceptable decrease in operating life. For example, it has been found that by operating PAR64 lamps (Nos. 1, 2, 5 and 6, for example), rated at 120 volts A.C. (rms), at approximately 140 volts D.C., the light intensity produced by the lamp is approximately doubled, with only a 40% (approximate) increase in power consumption. Efficiency in lumens per watt is thus increased at the expense of heat generation. Bulb life is maintained at an acceptable 200 hours as compared to a rated life of 400 hours at 120 volts A.C.

Thus, by providing the boosted D.C. supply circuit 10 in accordance with the present invention, the light intensity of lamp 18 not only can be doubled whenever desired, but can also be dimmed, in a conventional manner via dimmer board 20. Unlike standard tungsten-halogen laps and HMP lamps, this lamp does not hum and can be used in close proximity to boom microphones. Further, the circuit 10 in accordance with the present invention is very inexpensive, lightweight and compact, and can be attached directly to the luminaire.

It has been found that for lamps having rated voltages of 120 volts A.C. (rms), the beneficial results accruing to the present invention will be realized when the lamp is operated at a D.C. voltage from about 135 to 146 volts. The upper limit of 146 volts has been determined for tungsten-halogen lamps as the voltage level at which the lamp temperature increases to the point where the filament post will melt. The optimum voltage level has been determined to be approximately 140 volts D.C., for incandescent lamps, and in particular tungsten-halogen lamps having a voltage rating of 120 volts A.C. (rms).

The values of the components used in the circuit of FIG. 3, in order to produce a 140 volt D.C. level, where a 120 volt rms 60 cycle power supply voltage is employed, are as follows: R1=56k omhs; C=1,200 microfarads; R2=5k ohms. It will be appreciated that other combinations of component values can be used to produce the 140 volt D.C. level using the 120 volt A.C. supply voltage, and that still other component values may be employed where other supply voltages (such as the European standard) are available, to produce 140 volts D.C.

Further, although specific data are given herein for lamps rated at 120 volts A.C. (rms), the present invention may be employed for any incandescent lamp, in particular tungsten-halogen lamps, at any voltage rating, with the boosted D.C. voltage level applied to the lamp being adjusted accordingly. Also, the components in circuit 10 may be adjusted to accommodate a variety of power requirements depending upon the power consumption of the lamp 18. For example, when the lamp 18 has a power rating of 1,000 watts, the diodes D1–D4 may be of the type designated 1N 1186. For lamps rated at 5,000 watts, the diodes D1–D4 can be those designated SK7226/6026, and for lamps rated at 10,000 watts, the diodes may be of the type designated SK7354/6154.

Thus, the present invention provides an inexpensive lightweight, compact circuit for increasing the light output of an incandescent lamp, while actually increasing the efficiency of the lamp, and provides good lamp life, only moderately reduced from the expected life of the unboosted lamp. Further, the circuit in accordance with the present invention eliminates lamp hum and allows the lamp to be dimmed as desired. Since more lamp is output by the lamp for a given amount of power, less heat is generated by the lamps. By operating tungsten-halogen lamps rated at 120 volts A.C. (rms), at 140 volts D.C., each lamp will provide approximately twice as much light (with a 50% decrease in expected lamp life), thereby reducing by 50% the number of lamps required in the studio, resulting in great cost savings, a less cluttered environment, and an overall cooler lighting system.

Changes and variations to the present invention will occur to those skilled in the art in view of the foregoing description. It is intended that such changes and variations be encompassed so long as the present invention is employed, as defined by the following claims.

What is claimed is:

1. A circuit for supplying a boosted D.C. operating voltage to a tungsten-halogen lamp, for use in television, motion pictures, theater and professional photography, and the like, comprising:

a full wave rectifying circuit for receiving a standard A.C. mains supply voltage and for producing a rectified voltage at an output thereof; and a low pass filter, having a capacitor and an effective resistance connected, in parallel, across said output of the rectifier, to filter the rectified voltage, the value of the time constant of said filter being chosen so as to produce at said output an average D.C. voltage of between about 135 and 146 volts, for application to said lamp.

2. The circuit of claim 1 wherein the value of said time constant is chosen so as to produce at said output an average D.C. voltage on the order of approximately 140 volts.

3. The circuit of claim 2 wherein said supply voltage is approximately 120 volts A.C. (rms) and approximately 60 cycles per second, and said capacitor is approximately 1,200 microfarads.

4. A circuit for supplying a boosted D.C. operating voltage to a tungsten-halogen lamp, for use in television, motion pictures, theater and professional photography, and the like, comprising means for receiving a standard A.C. mains supply voltage and for providing, at an output, a rectified voltage, and means connected to said output for filtering said rectified voltage to produce at said output an average D.C. voltage on the order of approximately 140 volts, for application to said lamp.

5. In combination, a luminaire for use in television, motion pictures, theater and professional photography, and the like, comprising:

a tungsten-halogen lamp; and a circuit for supplying said lamp with a boosted D.C. operating voltage, including a full-wave rectifying circuit for receiving, at an input, a standard A.C. mains supply voltage and for producing a rectified voltage at an output thereof, and a low-pass filter, having a capacitor and an effective resistance connected, in parallel, across said output of the rectifier, to filter the rectified voltage, the value of the time constant of said filter being chosen so as to produce at said output an average D.C. voltage of between about 135 and 146 volts, for application to said lamp.

6. The lighting system of claim 5 further including a dummy resistor coupled to said input of said full-wave rectifying circuit, and a dimmer electrically connected to said input, for reducing the level of said average D.C. voltage as desired.

7. A method for increasing the light output and efficiency of a tungsten-halogen lamp, for use in television, motion pictures, theater and professional photography, and the like, comprising the steps of rectifying a standard A.C. mains supply voltage to produce a rectified voltage;

filtering said rectified voltage so as to provide an average D.C. voltage on the order of approximately 140 volts; and applying said average D.C. voltage to said tungsten-halogen lamp.

* * * * *